US005590437A

United States Patent [19]

McMillin

[11] Patent Number: 5,590,437

[45] Date of Patent: Jan. 7, 1997

[54] WOUND BROOM CONSTRUCTION

[75] Inventor: Kenneth L. McMillin, Dublin, Ohio

[73] Assignee: Vining Industries, Inc., Springfield, Ohio

[21] Appl. No.: 449,795

[22] Filed: May 23, 1995

[51] Int. Cl.[6] ..... A46B 5/02

[52] U.S. Cl. ..... 15/143.1; 15/189; 15/207

[58] Field of Search ..... 15/143.1, 159.1, 15/168, 170, 189, 171, 207; 16/111 R; 74/551.9

[56] References Cited

U.S. PATENT DOCUMENTS

| | | | |
|---|---|---|---|
| 968,518 | 8/1910 | Post . | |
| 987,981 | 3/1911 | Gross | 15/143.1 |
| 2,009,473 | 7/1935 | Britton | 16/111 R |
| 2,417,750 | 3/1947 | Hall | 15/159.1 |
| 3,345,669 | 10/1967 | Starry | 15/143.1 |
| 4,064,587 | 12/1977 | Schnabl | 15/175 |
| 4,222,562 | 9/1980 | Gardner | 15/159.1 |
| 4,554,705 | 11/1985 | Murray | 15/143.1 |
| 4,941,232 | 7/1990 | Decker et al. | 16/111 R |
| 5,133,101 | 7/1992 | Hauser et al. | 15/143.1 |
| 5,145,082 | 9/1992 | Craft et al. | 16/111 R |
| 5,274,872 | 1/1994 | Rich | 15/145 |

*Primary Examiner*—David Scherbel
*Assistant Examiner*—Terrence R. Till
*Attorney, Agent, or Firm*—Biebel & French

[57] ABSTRACT

A wound broom including an elongated tubular handle formed of metal and a plastic cover extending over an exterior surface of the handle. A plurality of elongated ribs are provided extending along the length of the handle, the ribs being defined by alternating lands and grooves. The lands include sharp edges and are spaced from each other a predetermined distance to provide a desired tactile feel for the handle and to facilitate gripping of the handle in a winding operation for the broom. In addition, a plastic plug and insert is provided in an end of the handle. The plug is provided with an aperture for receiving the leading end of a winding wire for facilitating initiation of a winding operation.

28 Claims, 5 Drawing Sheets

WOUND BROOM CONSTRUCTION

BACKGROUND OF THE INVENTION

1. Field of the Invention

This invention relates to a broom construction and, more particularly, to a wound broom construction including a tubular metal handle and an outer handle covering for facilitating construction and use of the broom.

2. Description of the Prior Art

Conventional wound brooms, such as corn brooms, have typically been constructed by providing a wooden handle and attaching broom corn to one end thereof. The broom corn is attached to the broom handle in a winding operation wherein the wooden handle is mounted within a chuck which rotates the handle while the broom corn is fed onto the handle. The broom corn is retained on the handle by a winding wire which wraps around the handle as the handle is rotated.

As a result of suitable wood for forming the handle becoming more expensive and difficult to obtain, alternative broom constructions have been proposed. For example, U.S. Pat. No. 4,064,587 to Schnabl discloses a broom construction including a handle formed of convolutely wound and glued paper. While such a construction decreases the use of the amount of wood used for a broom, this broom construction may be found to lack the strength provided by a wood construction, and further may be subject to greater deterioration of the handle than may be found in other constructions.

In addition, prior art wound brooms have typically included handles having smooth surfaces, such as a painted surface on the exterior of the handle. Such surfaces are susceptible to slipping in the user's hands and thus frequently do not provide an optimum grip for the broom.

SUMMARY OF THE INVENTION

In accordance with the present invention an implement is provided which includes a handle supporting a head for use in a cleaning operation. In particular, the implement includes an improved construction which improves the durability and tactile feel of the handle and which facilitates construction of the implement.

In a preferred embodiment of the invention, the implement comprises a wound broom including an elongated tubular metal handle and an extruded plastic cover extending over an exterior surface of the metal handle. A plurality of elongated ribs are defined extending along the length of the handle and are defined by alternating lands and grooves formed in the plastic cover. The lands and grooves provide a textured exterior surface for the broom for facilitating gripping of the handle by a person using the broom. In addition, the lands and grooves facilitate gripping of the handle within a collet chuck in a broom winding machine.

An elongated plastic plug is located at the bristle end of the broom for strengthening the end of the broom to resist forces applied radially inwardly on the handle, for example, the gripping force applied by a collet chuck during the winding operation. A portion of the plastic plug extends outside of the handle and includes an aperture for receiving an end of a winding wire for initiating a winding operation to attach strands or bristles, such as broom corn, onto the end of the broom handle.

Therefore, it is an object of the present invention to provide a broom construction including a tubular handle and having a plastic cover defining a plurality of elongated ribs along the handle.

It is a further object of the invention to provide a wound broom construction including a handle having a textured surface to facilitate gripping of the handle during manufacture and use of the broom.

It is yet another object of the invention to provide a wound broom construction including a tubular handle having a plug located in one end thereof to facilitate a winding operation for constructing the broom.

Other objects and advantages of the invention will be apparent from the following description, the accompanying drawings and the appended claims.

DETAILED DESCRIPTION OF THE PREFERRED EMBODIMENT

Figure 1:
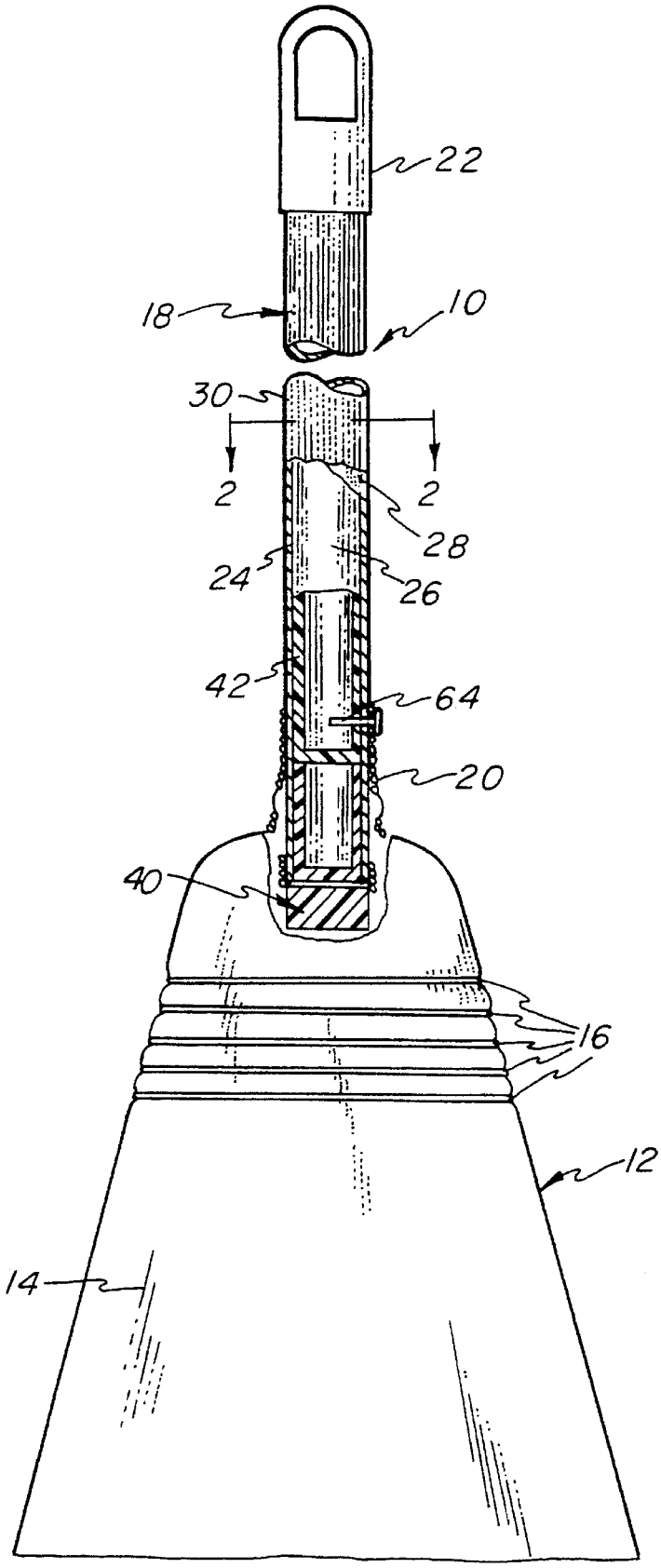
FIG. 1 is an elevational view of the wound broom construction of the present invention wherein portions of the broom are cut away to show details of the construction.

Referring initially to FIG. 1, a cleaning implement in the form of a wound broom 10 is illustrated and comprises a broom head 12 including bristles 14 formed of a conventional material, such as broom corn, and held together by a plurality of stitches 16. Upper ends of the bristles 14 are held onto a lower end of a handle 18 by a spirally wound winding wire 20. In addition, a cap 22 is provided at a top end of the handle 18.

Figure 3:
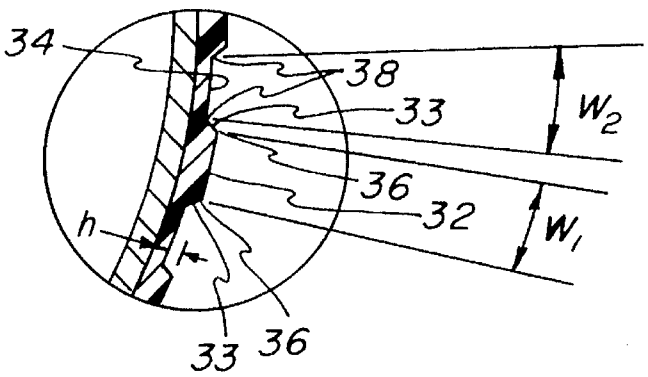
FIG. 3 is an enlarged view showing the details of the circled portioned A in FIG. 2.
Figure 2:
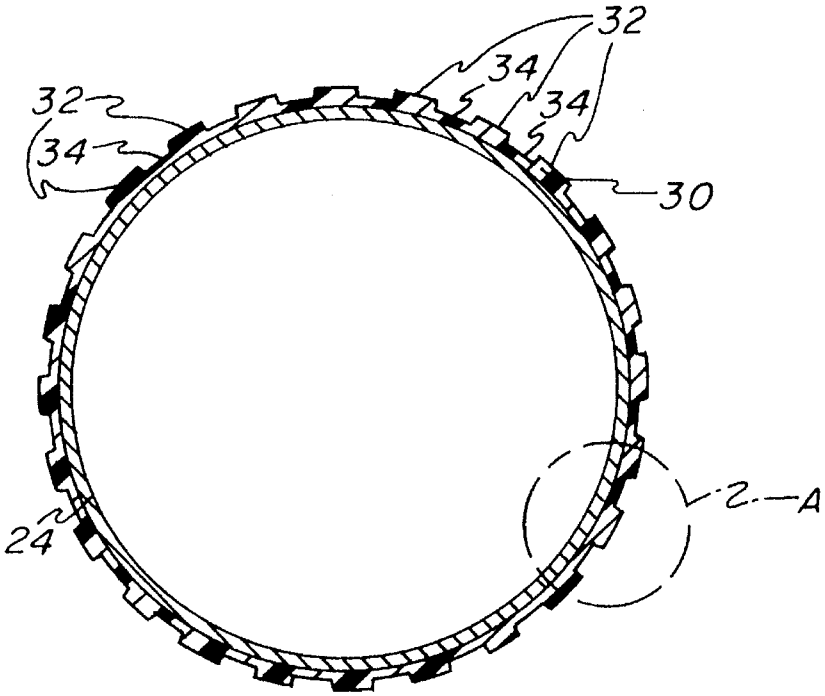
FIG. 2 is a cross-sectional view taken along line 2—2 in FIG. 1.

Referring to FIGS. 1–3, the handle 18 comprises an elongated tubular metal member 24. The tubular member 24 may be formed of any suitable metal, such as aluminum or steel. The tubular member 24 defines an interior surface 26 and an exterior surface 28, and an extruded plastic cover 30 is provided extending over the exterior surface 28. The plastic cover 30 includes a plurality of elongated ribs extending along the length of the handle 18 and defined by alternating lands 32 and grooves 34 formed in the plastic cover 30.

As best seen in FIG. 3, the lands 32 and grooves 34 are provided with substantially square edges 36 and 38, respectively, wherein the edges 36, 38 preferably have a radius of approximately 0.005 inch or less. Further, in one embodiment the tubular member 24 comprises a ⅞ inch diameter tube. In another embodiment, the tube may have a diameter of 15/16 inch or any other diameter available to broom construction. The thickness of the cover in the area of the grooves 34 is approximately 0.01 inch and the height h of the lands 32 above the grooves 34 is approximately 0.01 inch.

It should be noted that a width dimension $W_1$ of the lands 32, in the circumferential direction, is approximately 68% to 100% of a width dimension $W_2$ of the grooves 34, in the circumferential direction, and side portions 33 slope slightly outwardly from the lands 32 toward the grooves 34. Further in one embodiment, the width $W_1$ of the lands is 0.050 to 0.061 inch and the width $W_2$ of the grooves 34 is approximately 0.061 to 0.072 inch such that the dimension $W_1$ of each of the lands 32 is approximately 1.7 to 2.0 percent of the circumference of the cover 30 for the handle 18. The provision of the substantially square edges 36 on the lands 32 in combination with the spacing between the lands 32 provides a particularly beneficial tactile feel to the handle 18 facilitating use of the broom 10. In addition, this particular rib construction facilitates the manufacturing process of the broom 10, as will be described further below.

Figure 4:
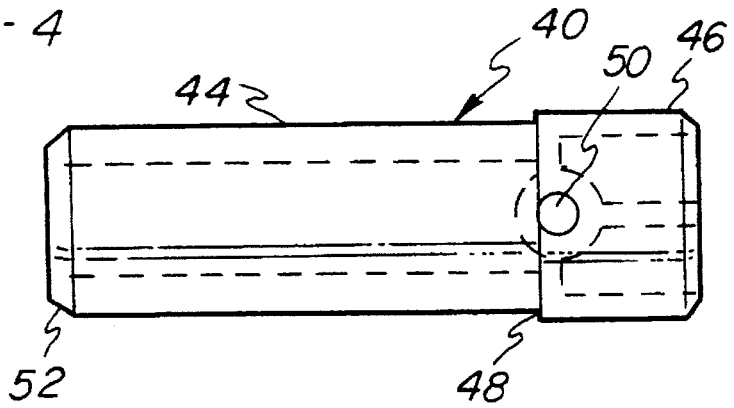
FIG. 4 is an elevational view of a plug for use in the broom construction.
Figure 5:
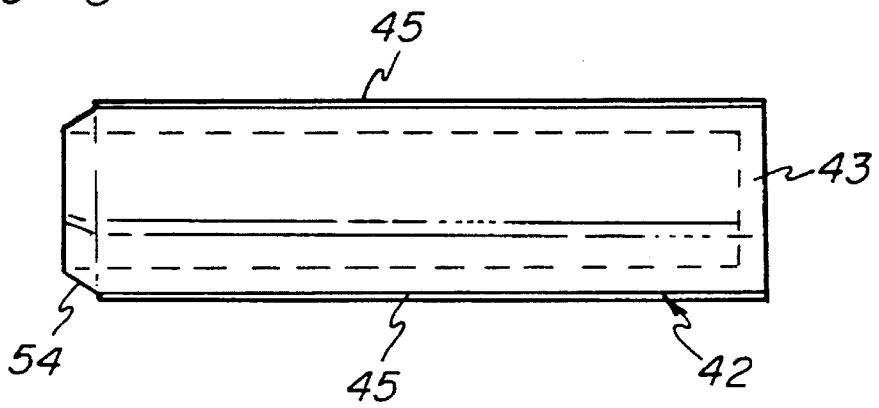
FIG. 5 is an elevational view of an insert for use in the broom construction.

Referring to FIGS. 1, 4 and 5, a plastic plug 40 is inserted into the lower end of the handle 18, and a plastic insert 42 is also inserted into the handle 18 above the plug 40 wherein the plug 40 and insert 42 are in frictional engagement with the interior surface 26 of the tubular member 24. The plug 40 and insert 42 are formed as elongated members abutting each other within the handle 18.

As seen in FIG. 4, the plug 40 includes a hollow forward portion 44 and a hollow enlarged head portion 46. A shoulder 48 is defined between the forward portion 44 and the enlarged portion 46 for abutting against the lower end of the handle 18. In addition, a through aperture 50 is defined through the enlarged head portion 46 for receiving the leading end of a winding wire 20, as will be described further below.

The insert 42 is formed as a substantially cylindrical hollow member including an endwall 43, and may be provided with short ribs 45 extending longitudinally along an outer surface of the insert 42 for facilitating frictional engagement with the interior surface 26 of the tubular member 24. It should be noted that both the plug 40 and insert 42 are preferably provided with respective chamfered edges 52, 54 for facilitating insertion of the plug 40 and insert 42 into the end of the handle 18.

Figure 6:
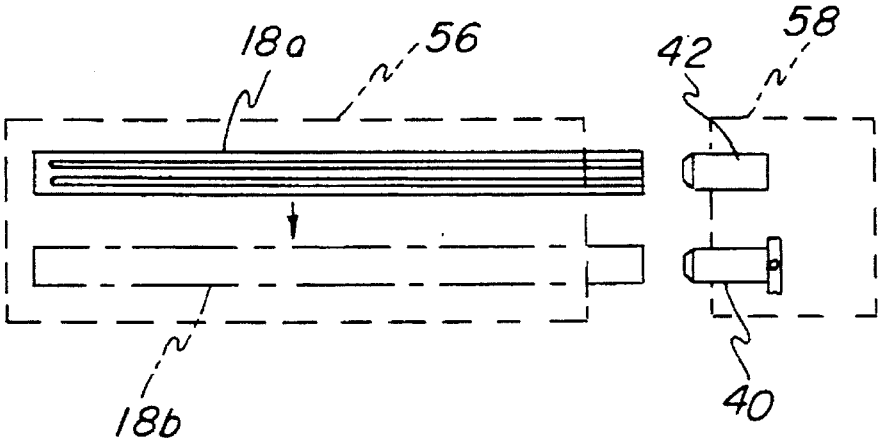
FIG. 6 is a diagrammatic illustration of the process for inserting the insert and plug into the handle of the broom construction.
Figure 7:
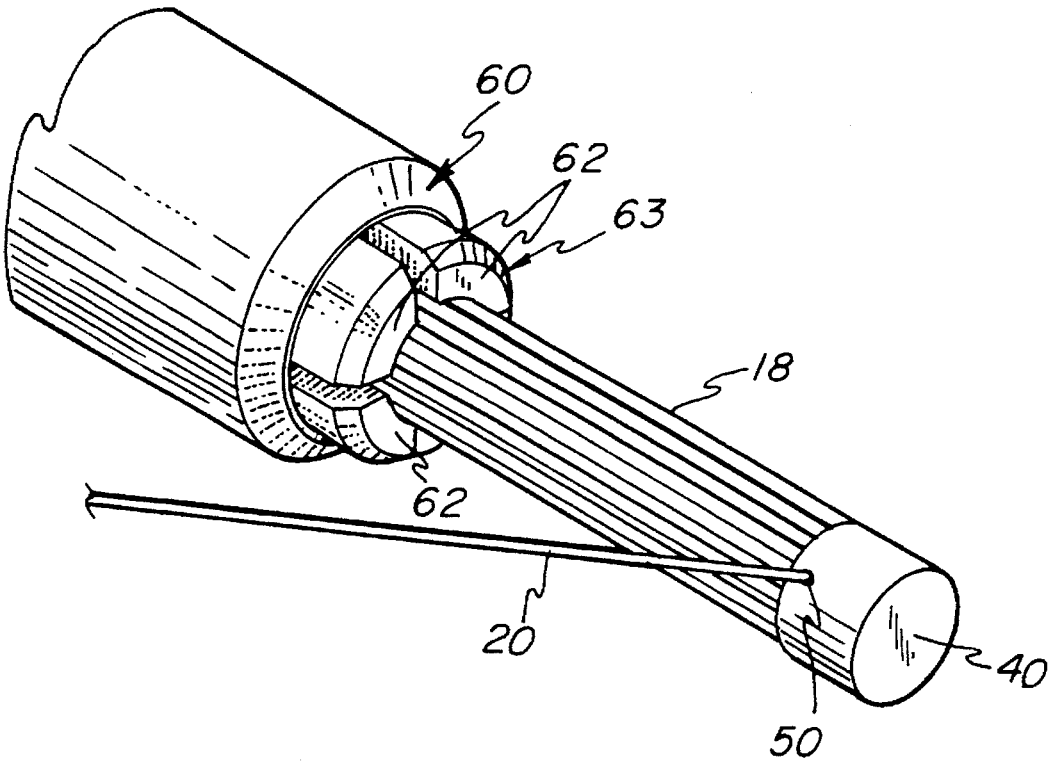
FIGS. 7 and 8 illustrate steps of the winding operation for attaching the bristles to the end of the handle.
Figure 8:
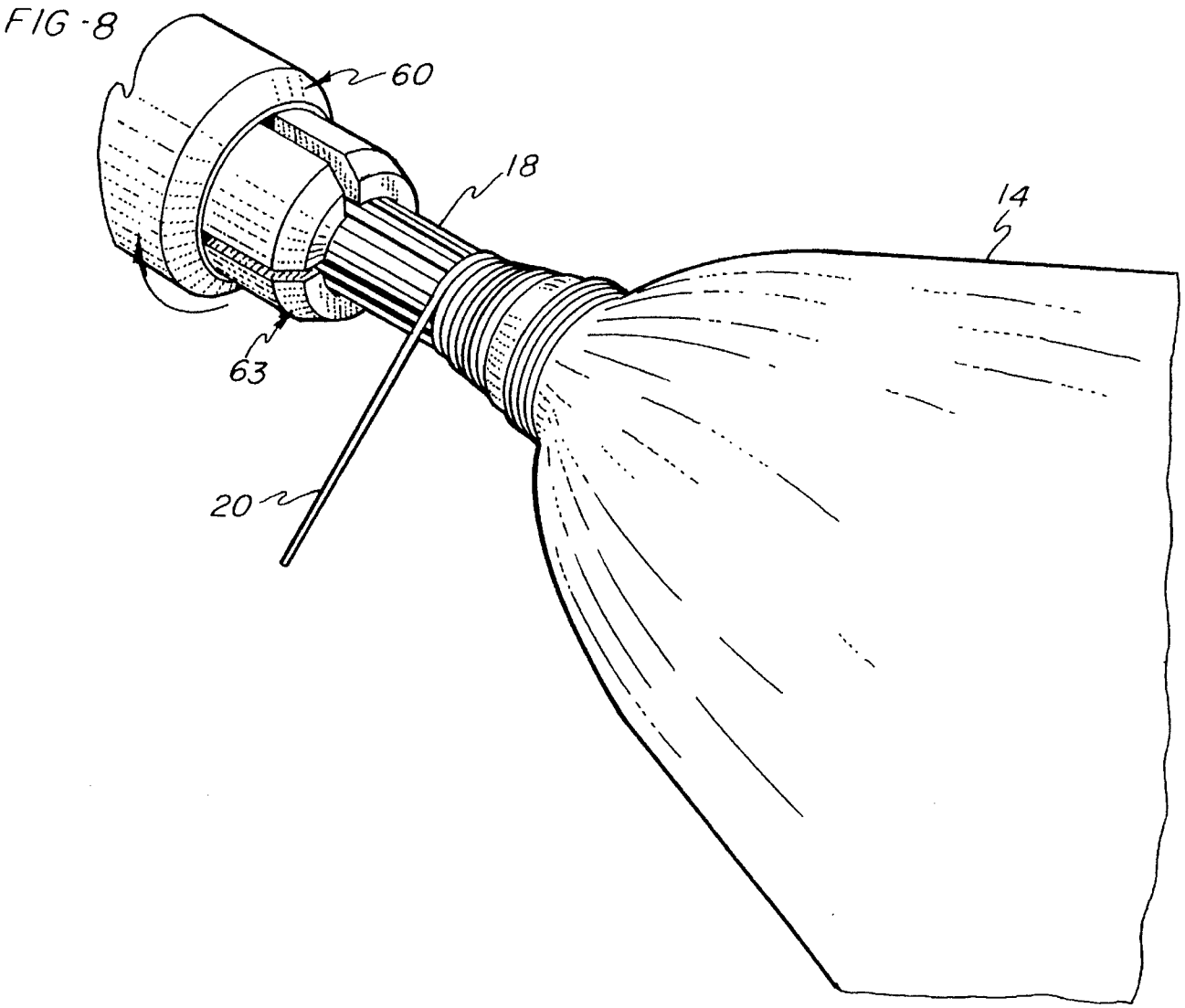

FIGS. 6–8 illustrate steps in a process for constructing the present broom 10. Initially, the metal tubular member 24 is provided with the cover 30 and is mounted within a support, illustrated diagrammatically by 56, for moving the handle 18 vertically relative to a loading mechanism, illustrated diagrammatically by 58. The handle 18 is positioned at the location of handle **18*a* in FIG. 6 such that it is aligned with an insert 42 in the loading mechanism 58. In this position, the insert 42 is moved into engagement within the interior surface of the handle 18*a*. The handle is subsequently moved to the position shown by handle 18*b* where the loading mechanism 58 causes the plug 40 to be inserted into engagement with the interior surface 26, and thereby causing the insert 42 to be further moved into the handle 18. The plug 40 is secured within the handle 18 by a staking process wherein small portions of the tubular member 24 are forced inwardly toward the plug 40**.

Referring to FIG. 7, the handle 18 is then placed in a collet chuck 60 wherein a collet 63 of the chuck 60 preferably includes gripping members 62 formed of a hard rubber or plastic material for gripping the handle 18. It should be noted that the plug 40 and insert 42 reinforce the handle 18 against forces applied radially inwardly by the gripping members 62 to thereby prevent deformation of the handle 18. Further, it should be apparent that the insert 42 provides an additional length within the handle 18 which is supported against radial forces to thereby permit a longer portion of the handle 18 to extend outwardly from the collet chuck 60.

With the handle 18 gripped within the collet 63 of the chuck 60, a leading end of the winding wire 20 is inserted through the aperture 50 in the plug 40 to initiate the winding operation. The chuck 60 is then caused to rotate while bristle material 14, such as broom corn, is fed onto the lower end of the handle 18 and held in place by spiral winds of the winding wire 20 in a manner known in the broom winding art.

Subsequently, a pin 64, such as a fastener, nail or staple, is driven through the handle 18 and insert 42, and the free end of the winding wire 20 is wrapped around the pin 64 to thereby anchor the end of the wire 20. Finally, the stitches 16 are applied to the bristles 14 and the end of the bristles 14 are trimmed to a desired shape.

It should be noted that by providing substantially square edges 36 to the lands 32 and providing sufficient spacing between adjacent lands 32, the gripping of the handle 18 within the collet chuck 60 is facilitated. In other words, the edges of the gripping members 62 positively catch against the edges 36 of the lands 32 to thereby prevent relative rotation or slippage between the collet 63 of the chuck 60 and the handle 18 during the winding operation, which slippage could cause distortion of the plastic cover 30.

Further, it should be noted that the plastic cover 30 is preferably formed of a copolymer, such as polypropylene, as opposed to other plastic materials such as homopolymers. For example, a polypropylene material sold under the trademark Tenite comprises a satisfactory material for the present application. It has been found that a copolymer has less tendency to crack while within the collet 63 as well as during insertion of the pin 64 through the handle 18.

It should be understood that the present invention may be applied to other cleaning implements having a construction similar to that described above. For example, yarn mops having a wound construction may be formed using the same technique as described above wherein yarn strands are wound onto the plastic covered handle. A mop constructed according to the above-described steps would only differ in that the plug 40 could be used without provision of the insert 42 to accommodate the winding requirements of the mop.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An implement comprising:

an elongated tubular handle defining a length, an interior surface and an exterior surface;

a plastic cover extending over said exterior surface;

a plurality of elongated ribs extending along the length of said handle and defined by alternating lands and grooves formed in said plastic cover;

strand material attached to an end of said handle;

wherein said lands are spaced around the circumference of said handle and occupy approximately 40 to 50 percent of the circumference of said handle and wherein said lands include edges having a radius of approximately 0.005 inch or less.

2. The implement as recited in claim 1 wherein said lands extend radially outwardly to a height which is approximately 0.01 inch above said grooves.

3. The implement as recited in claim 1 wherein approximately 24 lands and grooves are defined in said cover.

4. The implement as recited in claim 1 wherein said cover is formed of a copolymer.

5. The implement as recited in claim 4 wherein said copolymer comprises polypropylene.

6. The implement as recited in claim 1 wherein said implement is a wound broom and including a plug inserted in contact with said interior surface at said end of said handle, said plug including an end portion extending from said end of said handle.

7. The implement as recited in claim 6 wherein said end portion of said plug includes means defining an aperture for receiving an end of a winding wire to facilitate initiation of a broom winding operation.

8. The implement as recited in claim 6 wherein said end portion comprises an enlarged portion defining a shoulder for abutting said end of said handle.

9. The implement as recited in claim 6 including an insert positioned in said handle adjacent to said plug wherein said plug and said insert strengthen said handle against forces applied radially inwardly on said handle.

10. An implement comprising:

an elongated tubular handle defining an interior surface and an exterior surface;

a plastic cover extending over said exterior surface;

a plurality of elongated ribs extending along the length of said handle and defined by alternating lands and grooves formed in said plastic cover;

strand material attached to an end of said handle to define a head portion for said implement;

wherein said lands are spaced around the circumference of said handle and occupy approximately 40 to 50 percent of the circumference of said handle and wherein said cover is formed of a copolymer.

11. The implement as recited in claim 10 wherein said lands include substantially square edges.

12. The implement as recited in claim 10 wherein approximately 24 lands and grooves are defined in said cover, spaced around the circumference of said handle.

13. The implement as recited in claim 10 including an insert member positioned in contact with said interior surface at said end of said handle.

14. A cleaning implement comprising:

an elongated handle;

a plastic cover extending over the length of said handle;

a plurality of elongated ribs extending along the length of said handle and defined by alternating lands and grooves formed in said plastic cover;

means defining a head for said implement; and wherein said plastic cover is formed of a copolymer material.

15. The implement as recited in claim 14 wherein said means defining a head comprise bristles to form a broom.

16. The implement as recited in claim 14 wherein said copolymer comprises polypropylene.

17. A wound broom comprising:

an elongated tubular metal handle defining an interior surface and an exterior surface;

a plastic cover extending over said exterior surface;

a plurality of elongated ribs extending along the length of said handle and defined by alternating land and grooves formed in said plastic cover;

an elongated plug located in contact with said interior surface at an end of said handle;

bristles attached to said end of said handle; and wherein a dimension of said lands in a circumferential direction is 68% to 100% of a dimension of said grooves in said circumferential direction.

18. The implement as recited in claim 17 wherein said dimension of each of said lands is approximately 1.7 to 2.0 percent of the circumference of said cover.

19. The implement as recited in claim 17 wherein said plug includes an enlarged end portion extending outside of said handle.

20. The implement as recited in claim 17 including an aperture defined through said plug for receiving an end of a winding wire to facilitate initiation of a broom winding operation.

21. The implement as recited in claim 20 including a pin member extending into said handle and forming an anchor for an end of said winding wire opposite from the end of said winding wire received in said aperture through said plug.

22. The implement as recited in claim 17 wherein approximately 24 lands and grooves are defined in said cover, spaced around the circumference of said handle.

23. The implement as recited in claim 17 wherein each of said lands include substantially square edges to facilitate gripping of said handle within a collet chuck in a broom winding machine.

24. A wound broom comprising:

an elongated tubular metal handle defining an interior surface and an exterior surface;

an extruded cover formed of a plastic copolymer material extending over said exterior surface;

a plurality of elongated ribs extending along the length of said handle and defined by alternating lands and grooves formed in said plastic cover;

each said land including substantially square edges to facilitate gripping of said handle within a collet chuck in a broom winding machine;

an elongated plastic plug located in contact with said interior surface at an end of said handle, said plug including a shaft portion and an enlarged end portion adjacent to said shaft portion and defining a shoulder engaging an end of said handle;

an elongated insert located in contact with said interior surface adjacent to said plug, said insert and said plug reinforcing said handle against forces applied radially inwardly on said handle;

bristles attached to said end of said handle by means of a winding wire spirally wound around said handle;

means defining an aperture through said end portion of said plug for receiving an end of said winding wire to facilitate initiation of a broom winding operation;

a pin member extending into said handle and said insert to form an anchor for an end of said winding wire opposite from the end of said winding wire received in said aperture through said plug; and wherein a dimension of said lands in a circumferential direction is 68% to 100% of a dimension of said grooves in said circumferential direction, and said dimension of each of said lands in a circumferential direction is approximately 1.7 to 2.0 percent of the circumference of said cover.

25. A broom comprising:

an elongated tubular handle defining a length, an interior surface and an exterior surface;

a plastic cover extending over said exterior surface;

a plurality of elongated ribs extending along the length of said handle and defined by alternating lands and grooves formed in said plastic cover;

bristles attached to an end of said handle;

wherein said lands are spaced around the circumference of said handle and occupy approximately 40 to 50 percent of the circumference of said handle; and wherein said broom is a wound broom and including a plug inserted in contact with said interior surface at said end of said handle, said plug including an end portion extending from said end of said handle.

26. The implement as recited in claim 25 wherein said end portion of said plug includes means defining an aperture for receiving an end of a winding wire to facilitate initiation of a broom winding operation.

27. The implement as recited in claim 25 wherein said end portion comprises an enlarged portion defining a shoulder for abutting said end of said handle.

28. The implement as recited in claim 25 including an insert positioned in said handle adjacent to said plug wherein said plug and said insert strengthen said handle against forces applied radially inwardly on said handle.

* * * * *